United States Patent [19]

Jinnai et al.

[11] Patent Number: 4,604,631

[45] Date of Patent: Aug. 5, 1986

[54] CONTROL SYSTEM AND METHOD FOR CHARGE CONTROL INK JET PRINTER

[75] Inventors: Koichiro Jinnai, Kawasaki; Takao Fukazawa, Tokyo; Tadashi Ito, Yokohama; Takahisa Koike, Tokyo; Toshiharu Murai, Yokohama; Kazumi Ishima, Kashiwa, all of Japan

[73] Assignee: Ricoh Company, Ltd., Tokyo, Japan

[21] Appl. No.: 679,116

[22] Filed: Dec. 6, 1984

[30] Foreign Application Priority Data

Dec. 7, 1983 [JP] Japan ..... 58-231187

[51] Int. Cl.[4] ..... G01D 15/18

[52] U.S. Cl. ..... 346/1.1; 346/75

[58] Field of Search ..... 346/75, 1.1; 364/900; 400/124, 126

[56] References Cited

U.S. PATENT DOCUMENTS 4,198,642 4/1980 Gamblin ..... 346/75

4,380,017 4/1983 Ort ..... 346/140 R 4,400,791 8/1983 Kitado ..... 364/900

4,431,319 2/1984 Karaki ..... 400/124

*Primary Examiner*—E. A. Goldberg

*Assistant Examiner*—Gerald E. Preston

*Attorney, Agent, or Firm*—Oblon, Fisher, Spivak, McClelland & Maier

[57] ABSTRACT

A control system for a charge deflection type ink jet printer which prints out one character line of print data by a plurality of strokes on a paper is disclosed. Data associated with odd scanning lines are printed out by one printing stroke of a carriage, then the paper is fed by a predetermined amount, and then data associated with even scanning lines are printed out. Thereafter, the paper is fed by an amount produced by subtracting a number of dots corresponding to a predetermined number of odd or even scanning lines from a number of dots corresponding to the total number of the odd and even scanning lines.

11 Claims, 3 Drawing Figures

CONTROL SYSTEM AND METHOD FOR CHARGE CONTROL INK JET PRINTER

BACKGROUND OF THE INVENTION

The present invention relates to a control system for a charge control type, serial ink jet printer which prints out data on a plurality of consecutive scanning lines by a single printing stroke of a carriage.

Generally, an ink jet printer of the type described is designed to print out consecutive thirty-two scanning lines of data, which constitutes one character line, and then feed a paper by a distance complementary to thirty two scanning lines. This procedure is successful so far as alphanumeric and other character data are concerned. However, when it comes to graphic data such as pictures and graphs, the above procedure is not fully acceptable considering the connection of one line to the next, i.e. the link between adjacent character lines. One approach heretofore proposed to settle the interline link situation consists in printing out data on adjacent scanning lines in a link portion in an alternating or staggering fashion. Such an approach is not very effective, however, since it is apt to cause the link portion to appear undesirably bold when printed out.

SUMMARY OF THE INVENTION

It is therefore an object of the present invention to provide a control system for a charge control type ink jet printer which makes the link between adjacent character lines unnoticeable and, in addition, allows data to be printed out in an increased dot density without reducing the paper feed pitch.

It is another object of the present invention to provide a generally improved control system for a charge control type ink jet printer.

In a charge control type ink jet printer for printing out one character line of data on a plurality of strokes which includes an ink jet head, a carriage loaded with charging and deflecting devices, a carriage driver for driving the carriage in a horizontal scan direction, and a paper driver for feeding the paper in a vertical scan direction, a control system therefor of the present invention comprises a buffer memory for storing one character line of print data which is made up of a plurality of odd and even scanning lines, and a control circuit for controlling the head, carriage and carriage driver such that one of odd scanning lines and even scanning lines stored each in a predetermined number in the buffer memory are read thereoutof and printed out, (b) the paper is fed in the vertical scan direction by an amount equal to a predetermined number of dot pitches, (c) the other of the odd and even scanning lines stored in the buffer memory are read thereoutof and printed out alternating with the one of the odd and even scanning lines, and (d) the paper is fed by an amount equal to a number of dot pitches produced by subtracting a number corresponding to the predetermined number assigned to dot pitches from a number which is double the predetermined number assigned to the scanning lines, whereby the one character line of print data are fully printed out.

In accordance with the present invention, a control system for a charge deflection type ink jet printer which prints out one character line of print data by a plurality of strokes on a paper is disclosed. Data associated with odd scanning lines are printed out by one printing stroke of a carriage, then the paper is fed by a predetermined amount, and then data associated with even scanning are printed out. Thereafter, the paper is fed by an amount produced by subtracting a number of dots corresponding to a predetermined number of odd or even scanning lines from a number of dots corresponding to the total number of the odd and even scanning lines.

The above and other objects, features and advantages of the present invention will become more apparent from the following detailed description taken with the accompanying drawings.

DESCRIPTION OF THE PREFERRED EMBODIMENTS

While the control system for a charge control type ink jet printer of the present invention is susceptible of numerous physical embodiments, depending upon the environment and requirements of use, substantial numbers of the herein shown and described embodiments have been made, tested and used, and all have performed in an eminently satisfactory manner.

Figure 1:
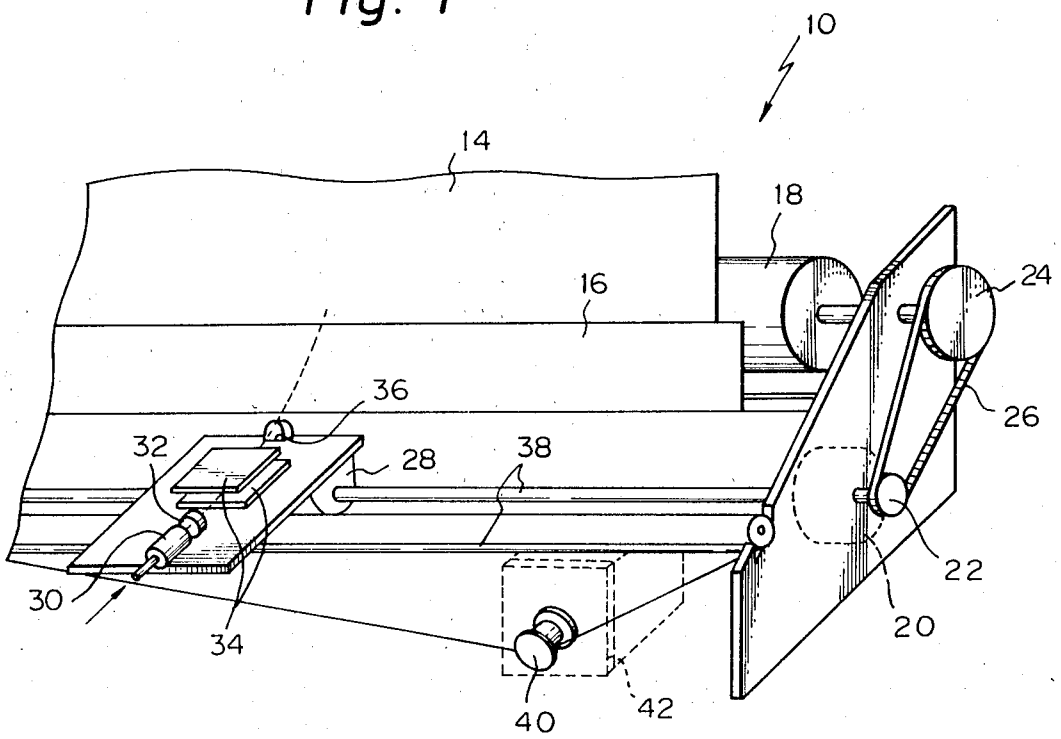
FIG. 1 is a fragmentary view of a charge control type ink jet printer to which the present invention is applicable.

Referring to FIG. 1 of the drawings, a charge control type ink jet printer to which the present invention is applicable is shown and generally designated by the reference numeral 10. The printer 10 comprises a paper pressing member, or bail, 16 for pressing a paper 14, a paper feed roller 18, a paper feed motor 20, gear elements 22 and 24, a timing belt 26, a carriage 28, an ink jet head 30, a charging electrode 32, a pair of flat deflection electrodes 34, a gutter 36, a carriage guide shaft 38, a pulley 40, and a carriage drive motor 42 for driving the carriage 28 in a reciprocal motion.

As well known in the printer art, ink is fed under a pressure of about 4.5 kg/cm$^2$ to the head 30 by a pump or the like (not shown). Meanwhile, a drive signal having a frequency of 132 kHz is applied to the head 30 so that ink drops are produced in the nozzle section of the head 30 timed to the drive signal. The moment a drop is separated from a jet of ink from the head 30, it flies with a charge deposited thereon which is complementary to a voltage applied to the charging electrode 32. Then, while advancing between the deflection electrodes 34, the ink drop is effected by a deflection force complementary to the amount of charged deposited thereon and, thereby, deflected upwardly. The deflected ink drop continues the flight until it impinges on the paper 14. By controlling the voltage applied to the charging electrode 32, it is possible to selectively direct ink drops toward a plurality of dot positions.

In the meantime, the carriage 28 is driven by the carriage drive motor 42 in a horizontal scan direction. The carriage 28 prints out data associated with a plurality of scanning lines by one printing stroke which occurs from the right end toward the left end of the paper 14.

Figure 2:
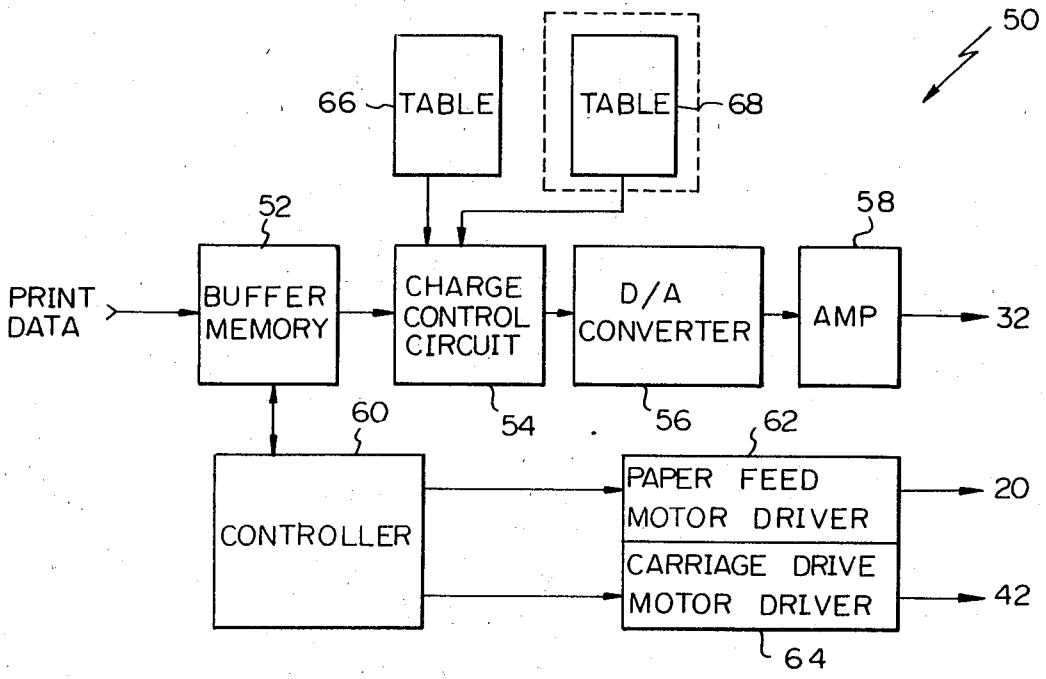
FIG. 2 is a block diagram representative of a preferred embodiment of the control system in accordance with the present invention.

Referring to FIG. 2, a control system embodying the present invention is shown in a block diagram. The control system, generally 50, comprises a buffer memory 52 to be supplied with print data, a charge control circuit 54, a digital-to-analog (DA) converter 56, an amplifier 58, a controller 60, a driver 62 associated with the sheet feed motor 20, a driver 64 associated with the carriage drive motor 42, and tables 66 and 68.

Figure 3:
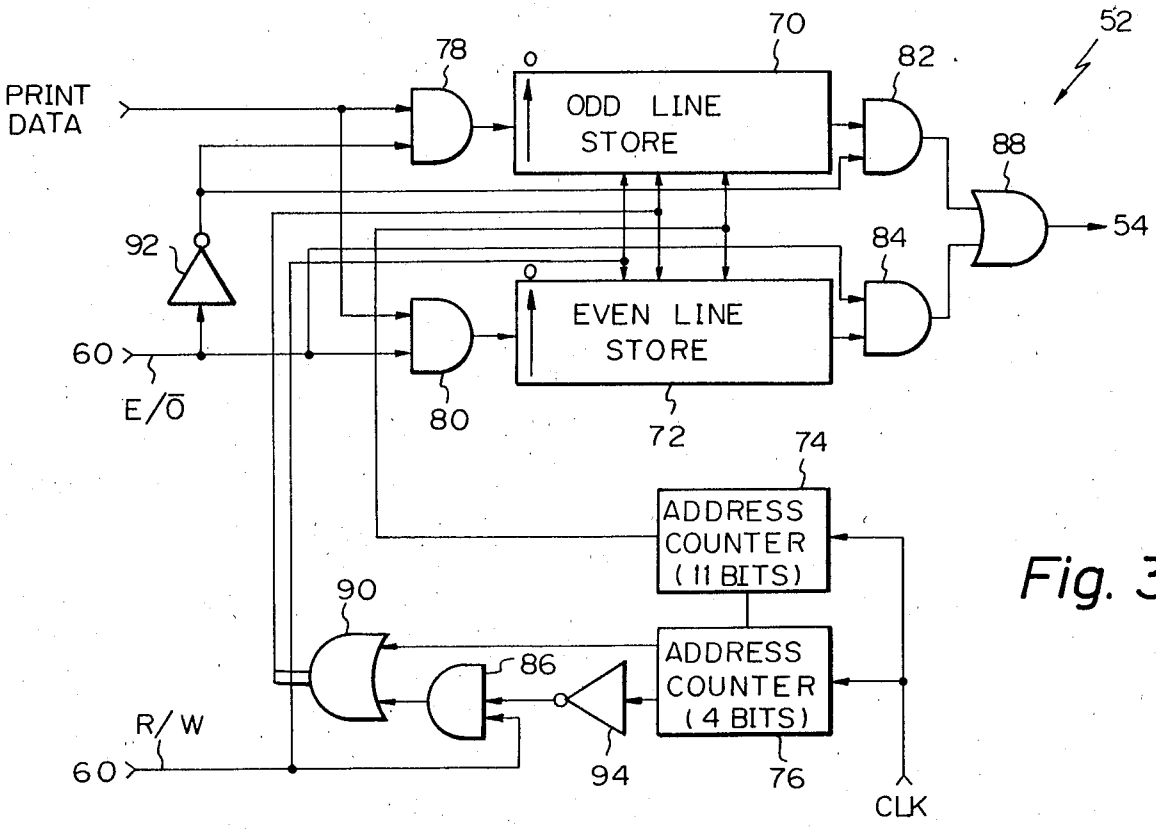
FIG. 3 is a block diagram showing details of a buffer memory included in the system of FIG. 2.

The buffer memory 52 included in the system of FIG. 2 is shown in detail in FIG. 3. The buffer memory 52 comprises a first store 70 assigned to odd scanning lines, a second store 72 assigned to even scanning lines, an 11-bit addres counter 74, a 4-bit address counter 76, AND gates 78, 80, 82, 84 and 86, OR gates 88 and 90, and inverters 92 and 94.

Referring to FIGS. 2 and 3, supplied to the buffer memory 52 are thirty-two scanning lines of print data, each line comprising 2,048 bits. The thirty-two scanning lines, or one character line, of print data are stored in the buffer memory 52. In detail, as shown in FIG. 3, when the first scanning line of data are applied to the buffer memory 52, the controller 60 turns output signals $E/\overline{O}$ and R/W thereof to low level. While data are written into the buffer memory 52, the four bits assigned to the address counter 76 provide an upper address and the eleven bits assigned to the address counter 74, a lower address which is associated with 2,048. By the above procedure, one scanning line of print data are stored in the odd line store 70. Next, upon the arrival of the second scanning line of data, the controller 60 makes the signal $E/\overline{O}$ high level to enable the even line store 72. These steps are repeated until all the thity-two scanning lines of data have been stored in the odd line store 70 and the even line store 72.

Thereafter, the controller 60 delivers a start signal to the driver 64 associated the carriage drive motor 42, whereby the motor 42 is energized to start moving the carriage 28 in a printing stroke. At the same time, the controller 60 turns the signal R/W to high level and the signal $E/\overline{O}$ to low level with the result that the data stored in the odd line store 70 are read out. At this instant, the address counter 74 provides an upper address and the address counter 76, a lower address. That is, a carry signal associated with the 4-bit address counter 76 is fed to the 11-bit address counter 74. The output of the address counter 76 is inverted by the inverter 94 and, then, routed to addresses of the respective stores 70 and 72, so that the data are individually read out in the directions as indicated by arrows in FIG. 3.

The data from the stores 70 and 72 are fed to the charge control circuit 54. The circuit 54 is adapted to charge or uncharge an ink drop depending upon code information stored in the table 66 and presence/absence of print data. The table 66 stores sixteen different levels of digitized codes in order to provide sixteen different levels of dot positions on the paper 16. The sixteen levels are so selected as to cover a dimension which is double the dot pitch. After sixteen odd scanning lines have been printed out, the paper 14 is fed a distance equal to one dot pitch. Then, the controller 60 makes the signal $E/\overline{O}$ high level to cause the even scanning lines to be printed out alternating with the odd lines. This is followed by feeding the paper 14 a distance complementary to the remaining number of dots (thirty-one) to print one complete character line of data.

In accordance with another embodiment of the present invention, the system is constructed to print out the odd scanning lines and, then, feed the paper 14 a distance equal to double the dot pitch. For the even scanning lines, the charge control circuit 54 selects information stored in the other table 68. The information stored in the table 68 are predetermined such that the amount of deflection becomes larger by one dot pitch relative to each of the codes associated with the odd scanning lines. In this construction, despite that the sheet 14 has been fed by two dot pitches, the even lines successfully fill the spacings between the odd lines. In short, the alternative embodiment is constructed to print out the odd scanning lines by one printing stroke of the carriage 28, then feeds the paper 14 by a small amount, then prints out the even scanning lines by the next printing stroke of the carriage 28, and then feeds the paper 14 by the remaining amount, thereby fully printing out one character line of data.

In summary, it will be seen that the present invention provides a control system for a charge control type ink jet printer which evens up scatterings of paper feed and deflection and, thereby, allows adjacent character lines to appear smoothly interlinked when printed out. The system is also effective to suppress mutual interference of ink drops and, therefore, distortion by virtue of the doubled deflection pitches. In addition, the system is capable of printing out data by one dot pitch without increasing the resolution in paper feed.

Various modifications will become possible for those skilled in the art after receiving the teachings of the present disclosure without departing from the scope thereof.

What is claimed is:

1. In a charge control type ink jet printer for printing out one character line of data on a paper by a plurality of strokes which includes an ink jet head, a carriage loaded with charging means and deflecting means, carriage driving means for driving the carriage in a horizontal scan direction, and paper driving means for feeding the paper in a vertical scan direction, a control system therefor comprising:

buffer memory means for storing one character line of print data which is made up of a plurality of odd and even scanning lines; and control means for controlling the head, the carriage and the carriage driving means such that (a) one of odd scanning lines and even scanning lines, each having a predetermined number of lines stored in said buffer memory means, are read therefrom and printed out, (b) the paper is fed in the vertical scan direction by an amount equal to a predetermined number of dot pitches, (c) the other of the odd scanning lines and even scanning lines stored in the buffer memory means are read therefrom and printed out, so as to alternate with said one of the odd scanning lines and even scanning lines, and (d) the paper is fed in the vertical scan direction by a number of dot pitches equal to twice said predetermined number of lines minus said predetermined number of dot pitches, whereby the one character line of print data are fully printed out.

2. A control system as claimed in claim 1, wherein the predetermined number of dot pitches is one.

3. A control system as claimed in claim 1, wherein the predetermined number of dot pitches is two.

4. A control system as claimed in claim 3, wherein the control means is constructed to control the deflecting means such that an amount of deflection increases by an amount equal to one dot.

5. A control system as claimed in claim 1, wherein the buffer memory means comprises a store for storing the odd scanning lines and a store for storing the even scanning lines.

6. A control system as claimed in claim 5, wherein said buffer memory means further comprises a first address counter, a second address counter and a clock input, said first and second address counters receiving said clock input and producing outputs which are connected to said store for odd scanning lines and said store for even scanning lines.

7. In a charge control type ink jet printer for printing out one character line of data on a paper by a plurality of strokes which includes an ink jet head, a carriage loaded with charging means and deflecting means, carriage driving means for driving the carriage in a horizontal scan direction, and paper driving means for feeding the paper in a vertical scan direction, a control method comprising the steps of:

storing one character line of print data which is made of a plurality of odd and even scanning lines in a buffer memory means;

reading from said buffer memory means one of the odd scanning lines and even scanning lines, each of which contains a predetermined number of lines;

printing the line read from said buffer memory means;

feeding the paper in the vertical scan direction by an amount equal to a predetermined number of dot pitches;

reading from said buffer memory means the other of the odd scanning lines and even scanning lines;

printing said other scanning lines so as to alternate said one scanning lines and said other scanning lines;

feeding the paper in the vertical scan direction by a number of dot pitches equal to twice said predetermined number of lines minus said predetermined number of dot pitches;

whereby the head, the carriage and the carriage driving means are controlled to fully print out one character line of print data.

8. A control method as claimed in claim 7, wherein the predetermined number of dot pitches is 1.

9. A control method as claimed in claim 7, wherein the predetermined number of dot pitches is 2.

10. A control method as claimed in claim 9, further comprising the step of:

controlling the deflecting means so that the amount of deflection increases by an amount equal to 1 dot.

11. In a charge control type ink jet printer for printing out one character line of data on a paper by a plurality of strokes which includes an ink jet head, a carriage loaded with charging means and deflecting means, carriage driving means for driving the carriage in a horizontal scan direction, and paper driving means for feeding the paper in a vertical scan direction, a control system therefor comprising:

buffer memory means for storing one character line of print data which is made up of a plurality of odd and even scanning lines and including:

a first address counter and a second address counter, each of said address counters connected to a clock input for counting clock signals therefrom;

first logic means connected to the output of said first address counter and also connected to a read/write input;

a second logic means connected to an odd/even input and a print input;

a first store for storing the odd scanning lines and a second store for storing the even scanning lines, said stores connected to the output of said second address counter, the output of said first logic means, the output of said second logic means and the read/write input;

third logic means connected to the outputs of said first and second stores and the odd/even input, to produce a buffer memory output; and control means for controlling the head, the carriage and the carriage driving means whereby the one character line of print data is fully printed out.

* * * * *